United States Patent [19]

Read

[11] 4,244,304

[45] Jan. 13, 1981

[54] SECURITY BOX AND MOUNTING PLATE

[76] Inventor: Ronald H. Read, 666 Tower Mews, Oakdale, N.Y. 11769

[21] Appl. No.: 91,696

[22] Filed: Nov. 6, 1979

[51] Int. Cl.[3] ..... E05G 1/04; A45C 1/12

[52] U.S. Cl. ..... 109/52

[58] Field of Search ..... 109/50, 51, 52

[56] References Cited

U.S. PATENT DOCUMENTS

| | | | |
|---|---|---|---|
| 1,340,377 | 5/1920 | Cott | 109/51 |
| 1,758,361 | 5/1930 | Frost | 109/51 |
| 2,410,475 | 11/1946 | Anderson | 109/51 |
| 2,635,563 | 4/1953 | McBride | 109/52 |
| 3,146,739 | 9/1964 | Furman | 109/52 |

FOREIGN PATENT DOCUMENTS

| | | | |
|---|---|---|---|
| 1017185 | 9/1952 | France | 109/52 |

*Primary Examiner*—Reinaldo P. Machado
*Attorney, Agent, or Firm*—Kevin Redmond

[57] ABSTRACT

A box and mounting plate in which the same lock is used to lock the box and secure it to the mounting plate by holding a lip of one section of the mounting plate beneath the box cover. The box can be released from the mounting plate by unlocking it and removing the mounting plate lip. Once the box is released from the mounting plate, it may be converted to a portable security box. Fabrication is simplified by requiring most sheet metal components to have only one simple bend.

2 Claims, 3 Drawing Figures

SECURITY BOX AND MOUNTING PLATE

BACKGROUND

1. Field

This invention relates to security boxes and, in particular, to such boxes in association with mounting plates.

2. Prior Art

There are prior art security boxes in which the same lock is used to lock the box as well as secure the box to a mounting plate, as shown in Cott, U.S. Pat. No. 1,340,377; however, Cott uses a hasp which detracts from the appearance of the box. In another U.S. Pat. No. 3,741,132 by Blower, the lock is used to secure the box to the mounting plate, but the box cannot be locked separately.

Often these boxes and mounting plates require complex bends of their sheet metal components, appreciably increasing their cost.

SUMMARY

It is an object of the present invention to provide a security box in which the same lock is used to lock the box and secure it to a mounting plate.

It is an object of the present invention to improve the appearance of this type of security box by eliminating the use of a hasp found on prior art devices.

It is an object of the present invention to facilitate the manufacture of a security box and a mounting plate by requiring in most cases only one or two simple bend to form the component parts.

In the present invention, a security box is secured to a mounting plate by locking a lip of the mounting plate beneath the cover. The box is released from the mounting plate by unlocking the box and simply removing the lip from under the box cover. After releasing the lip, the box becomes a portable security box which employs the same lock to lock the box as was used to secure it to the mounting plate.

DETAILED DESCRIPTION OF THE INVENTION

Figure 1:
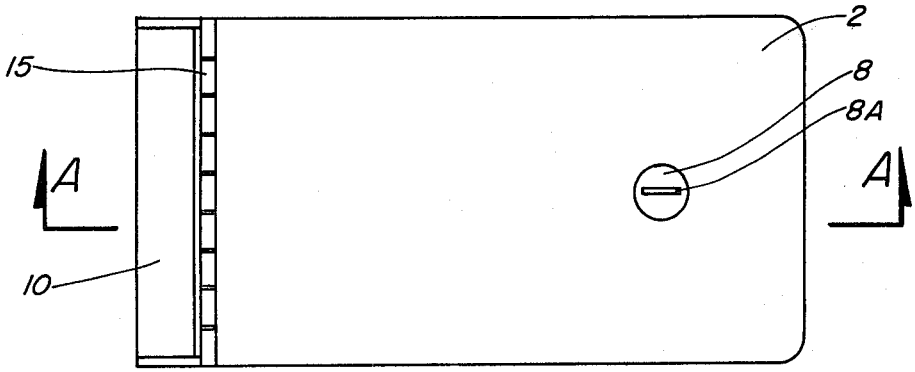
FIG. 1 is a top plan view of the subject invention.

FIG. 1 shows the top cover 2 in which a lock 8 is mounted near one edge. Lock 8 contains a keyhole 8A. On the edge of the cover opposite the lock is a hinge 15 which is used to permit lifting the cover to expose the contents of the box.

Figure 2:
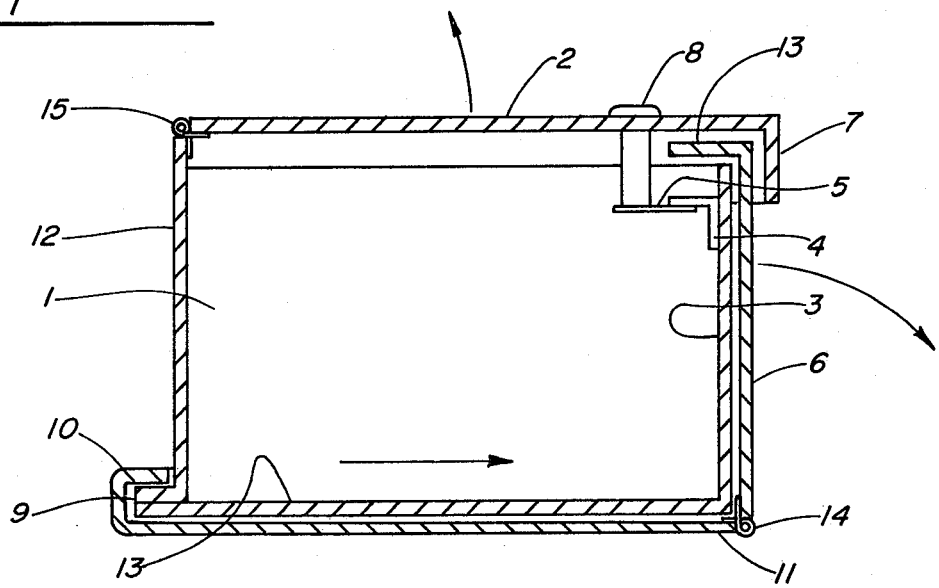
FIG. 2 is a cross sectional side view of the invention.

FIG. 2 is a cross sectional view of the box taken along the line A—A, shown in FIG. 1. The box includes, in addition to a cover 2, a back 12, a bottom 13, and a front 3. Beneath the box is a first section of a mounting plate 11, connected to a second section 6, by means of a hinge 14. The section 11 is approximately the same size as the bottom of the box. The second section 6 is approximately the same size as the front of the box and is positioned adjacent the front of the box. The hinge 14 is positioned adjacent the junction of the bottom of the box 13 and front of the box 3.

The lock 8 extends through the cover 2 into the box and at its end includes a locking arm 5. The locking arm rotates when a key is placed in the keyhole 8A and is rotated. A latch 4 is in the form of a bracket which is connected to the inside of the front plate and extends inward at a height slightly above locking arm 5. Rotating the arm under the latch locks the box.

Cover 2 includes a first lip 7 which extends downward over the front of the box from the edge of the cover adjacent the lock 8. The second section of the mounting plate 6 contains a second lip 13 which extends into the box when the section of the mounting plate is positioned vertically. The second lip secures the front of the box to the mounting plate, while the first lip holds the second lip in the securing position.

The first section of the mounting plate 11 includes a detent 10 at the end adjacent the back of the box. The bottom 13 of the box includes a projection 9 which extends beyond the rear of the box into the detent 10 to hold the rear of the box to the mounting plate. To strengthen the projection, a portion of the back of the box is bent orthogonally to join and form a part of the projection 9.

Figure 3:
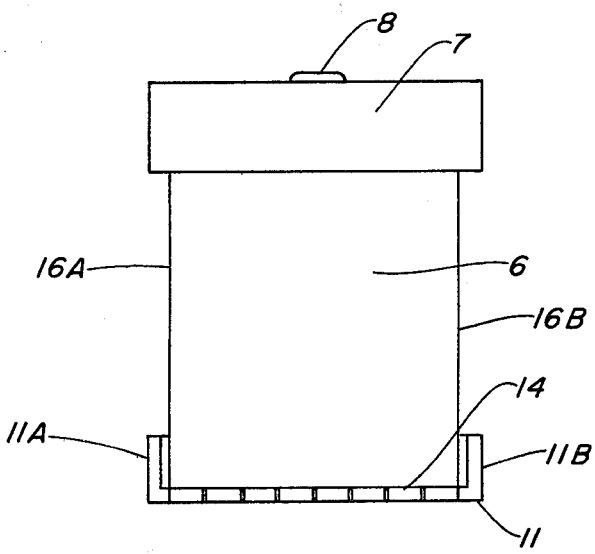
FIG. 3 is a front view of the invention.

In FIG. 3, the two sides of the box are indicated by drawing numerals 16A and 16B. The first section of the mounting plate includes two sides, 11A and 11B which extend upward and orthogonal to the base plate and generally, parallel to the sides 16A and 16B, respectively. These sides prevent the box from being removed from the mounting plate by lateral movement.

In the operation of the present invention, the second section of the base plate is rotated upward and placed under the cover such that the lip 7 prevents the mounting plate 6 from being removed when the box is locked. The box is locked by rotating the locking arm 5 beneath the latching means 4. When the locking arm is in this position, the cover 2 cannot be moved. The rear of the box is secured to the mounting plate by the projection of the bottom 9 which is held within the detent 10. The detent and the lip 13 together prevent the box from being moved away from the base plate in an upward or fore and aft direction. Sides 11A and 11B of the base plate prevent the box from being moved away from the base plate in a lateral direction.

To use the security box as a portable device, the locking arm is rotated by means of a key. The cover is lifted about the hinge 15. The second section of the mounting plate 6 is rotated downward out of engagement with the box. The box is then removed from the detent, locked and transported away from the mounting plate.

FIG. 3 illustrates the uncluttered outline of the present invention. The box is securely locked to the mounting plate, but there is no use of a hasp as was present in prior art devices to detract from the appearance.

Having described my invention, I claim:

1. In combination, a security box and mounting plate, comprising:

(a) a box having four sides positioned in a general rectangular configuration, a bottom and a rotatable top cover, said box being held with the bottom forming the lower surface for reference purposes, (b) a first hinge connecting the cover to a first side of the box to permit rotating the cover about the hinge to expose the contents of the box, (c) a first lip connected to the cover along the edge opposite the hinge, said lip extending downward with respect to the cover and said lip extending outside and parallel to a portion of a second side of the box, said second side being located opposite said first side, (d) a locking means of the type designed to accept a key, said locking means being mounted to the cover adjacent the lip and extending through the cover with the portion having the key receptacle facing outward of the cover, (e) a locking arm means connected to the lower portion of the lock and extending generally orthogonal to the lock and parallel with the cover, said locking arm means being connected to the locking means to rotate when a key which has been inserted in the lock is rotated, (f) a latching means attached to and extending orthogonally with respect to inside of the second side of the box at a height above that which the locking arm takes when the cover is closed, said latching means holding the cover closed when the locking arm is rotated to a position directly beneath the latching means, (g) a projection located generally in the plane of the bottom of the box, said projection extending beyond the first side of the box, (h) a mounting plate comprising:

(1) a first section approximately the size of and positioned adjacent the bottom of the box, said first section having two sides which extend upwards adjacent the sides of the box, (2) a detent to accept the projection, said detent being attached to the first section of the mounting plate and positioned at the end adjacent to and positioned to accept the projection, (3) a second section located adjacent to and having generally the same size as the second side of the box, (4) a second hinge connecting the first and second sections of the mounting plate at their edges and located adjacent the junction of the second side of the box and the bottom of the box, (5) a second lip attached to the second portion of the mounting plate on the edge opposite the second hinge said second lip extending orthogonally with respect to the second portion of the mounting plate and beneath the box cover to hold the box to the mounting plate when the locking arm is placed beneath the latching means.

2. A combination as claimed in claim 1, wherein said projection is formed of an extension of the bottom of the box together with and in close proximity to an orthogonal extension of the first side of the box.

* * * * *